US009957694B2

(12) United States Patent
Jones et al.

(10) Patent No.: US 9,957,694 B2
(45) Date of Patent: May 1, 2018

(54) SYSTEM AND METHOD FOR SEAFLOOR STOCKPILING

(75) Inventors: Glen Robert Jones, Milton (AU); Daal Hallam Jaffers, Milton (AU); Roland Gunter Berndt, Milton (AU)

(73) Assignee: Eda Kopa (Solwara) Limited, Port Moresby (PG)

( * ) Notice: Subject to any disclaimer, the term of this patent is extended or adjusted under 35 U.S.C. 154(b) by 0 days. days.

(21) Appl. No.: 14/126,845

(22) PCT Filed: Jun. 15, 2012

(86) PCT No.: PCT/AU2012/000695

§ 371 (c)(1),
(2), (4) Date: Feb. 8, 2014

(87) PCT Pub. No.: WO2012/171074

PCT Pub. Date: Dec. 20, 2012

(65) Prior Publication Data

US 2014/0137442 A1 May 22, 2014

(30) Foreign Application Priority Data

Jun. 17, 2011 (AU) ..... 2011902371

(51) Int. Cl.

| | |
|---|---|
| ***E02F 7/10*** | (2006.01) |
| ***E02F 7/00*** | (2006.01) |
| ***E21C 50/00*** | (2006.01) |

(52) U.S. Cl.

CPC ..... *E02F 7/10* (2013.01); *E02F 7/005* (2013.01); *E21C 50/00* (2013.01)

(58) Field of Classification Search

CPC ..... E02F 7/10; E02F 7/005; E21C 50/00
USPC ..... 37/307, 314, 317, 333
See application file for complete search history.

(56) References Cited

U.S. PATENT DOCUMENTS

| | | | | | |
|---|---|---|---|---|---|
| 371,686 | A | * | 10/1887 | Howell | 37/333 |
| 1,100,753 | A | * | 6/1914 | Long | 37/333 |
| 1,492,817 | A | * | 5/1924 | Swintek | 37/319 |
| 1,691,686 | A | * | 11/1928 | Vorhies | 37/323 |
| 1,729,054 | A | * | 9/1929 | Shotwell | 37/333 |
| 2,205,490 | A | * | 6/1940 | Peterson | 37/308 |
| 3,010,232 | A | * | 11/1961 | Skakel et al. | 37/195 |
| 3,438,142 | A | | 4/1969 | Krutein | |

(Continued)

FOREIGN PATENT DOCUMENTS

| | | |
|---|---|---|
| CN | 2229514 | 6/1996 |
| JP | 55-114795 A | 9/1980 |

(Continued)

*Primary Examiner* — Jamie L McGowan
(74) *Attorney, Agent, or Firm* — McDonnell Boehnen Hulbert & Berghoff LLP

(57) ABSTRACT

A system and method for stockpiling material on the seafloor, the system and method using seafloor collection machines, such auxiliary or bulk cutters or collection machines, to capture seafloor material to be stockpiled. The captured seafloor material is carried in slurry form over a flexible transfer pipe to an outlet at a desired seafloor site. In a preferred form the outlet is mounted in a seafloor stockpiling hood that sits on the seafloor at the desired seafloor site and captures and contains slurry from the outlet while allowing egress of water. The captured seafloor material can then be extracted to a surface vessel.

15 Claims, 12 Drawing Sheets

(56) References Cited

U.S. PATENT DOCUMENTS

| | | | | |
|---|---|---|---|---|
| 3,820,258 | A * | 6/1974 | Fahrner | 37/317 |
| 3,945,394 | A * | 3/1976 | Sullivan et al. | 137/430 |
| 3,971,593 | A | 7/1976 | Porte et al. | |
| 4,070,061 | A * | 1/1978 | Obolensky | 299/8 |
| 4,092,790 | A * | 6/1978 | Sonerud | 37/340 |
| 4,141,159 | A | 2/1979 | Morris et al. | |
| 4,147,390 | A * | 4/1979 | Deliege et al. | 299/8 |
| 4,155,491 | A * | 5/1979 | Istoshin et al. | 222/371 |
| 4,195,426 | A | 4/1980 | Banzoli et al. | |
| 4,232,903 | A | 11/1980 | Welling et al. | |
| 4,480,569 | A | 11/1984 | van der Veen et al. | |
| 4,503,629 | A * | 3/1985 | Uchida | 37/314 |
| 4,685,742 | A | 8/1987 | Moreau | |
| 4,839,061 | A * | 6/1989 | Manchak, Jr. et al. | 210/743 |
| 5,970,635 | A * | 10/1999 | Wilmoth | 37/323 |
| 8,091,255 | B2 * | 1/2012 | Drabble | 37/307 |
| 8,127,474 | B2 * | 3/2012 | Phillips | 37/334 |
| 8,678,514 | B2 * | 3/2014 | Efthymiou | E02F 3/8866 299/8 |
| 8,801,938 | B2 * | 8/2014 | Allen | 210/747.4 |
| 2009/0077835 | A1 | 3/2009 | Yu et al. | |
| 2011/0296720 | A1 * | 12/2011 | Tack | 37/323 |

FOREIGN PATENT DOCUMENTS

| | | | | |
|---|---|---|---|---|
| JP | 57190844 | A * | 11/1982 | E02F 3/92 |
| JP | 05-71237 | | 9/1993 | |
| JP | 06-173570 | | 6/1994 | |
| JP | 06-173570 | A | 6/1994 | |
| JP | 2003193788 | A | 7/2003 | |
| JP | 2009280960 | | 12/2009 | |
| WO | 2005/093215 | | 10/2005 | |
| WO | 2009078731 | A2 | 6/2009 | |
| WO | 2009120090 | A2 | 10/2009 | |
| WO | 2010092145 | A1 | 8/2010 | |
| WO | 2011008447 | A1 | 1/2011 | |
| WO | 2011/156866 | A1 | 12/2011 | |
| WO | 2011/156867 | A1 | 12/2011 | |
| WO | 2011156865 | A1 | 12/2011 | |

* cited by examiner

SYSTEM AND METHOD FOR SEAFLOOR STOCKPILING

CROSS REFERENCE TO RELATED APPLICATIONS

The present application is a 35 U.S.C. 371 National Application of PCT/AU2012/000695, filed Jun. 15, 2012, which claims priority to Australian Patent Application No. 2011902371, filed Jun. 17, 2011.

TECHNICAL FIELD

The present invention relates generally to underwater mining, and in particular relates to a system and method for seafloor stockpiling. In particular the invention relates, but is not limited, to mining, gathering, and stockpiling resources on the seafloor using a plurality of cooperating seafloor tools.

BACKGROUND OF THE INVENTION

Seabed excavation is often performed by dredging, for example to retrieve valuable alluvial placer deposits or to keep waterways navigable. Suction dredging involves positioning a gathering end of a pipe or tube close to the seabed material to be excavated, and using a surface pump to generate a negative differential pressure to suck water and nearby mobile seafloor sediment up the pipe. Cutter suction dredging further provides a cutter head at or near the suction inlet to release compacted soils, gravels or even hard rock, to be sucked up the tube. Large cutter suction dredges can apply tens of thousands of kilowatts of cutting power. Other seabed dredging techniques include auger suction, jet lift, air lift and bucket dredging.

Most dredging equipment typically operates only to depths of tens of meters, with even very large dredges having maximum dredging depths of little more than one hundred meters. Dredging is thus usually limited to relatively shallow water.

Subsea boreholes such as oil wells can operate in deeper water of up to several thousand meters depth. However, subsea borehole mining technology does not enable seafloor mining.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY OF THE INVENTION

According to a first aspect, the present invention provides a system for seafloor stockpiling, the system comprising:

a flexible transfer pipe for carrying slurry from a slurry inlet to a slurry outlet; wherein the slurry inlet receives slurry from a seafloor collection machine; and the slurry outlet, positioned at a desired location distal from the slurry inlet, delivers the slurry to a seafloor site.

According to a second aspect, the present invention provides a method for seafloor stockpiling, the method comprising:

capturing seafloor material in a slurry form;

carrying captured slurry through a flexible transfer pipe to a slurry outlet; and positioning the slurry outlet at a desired seafloor site distal from the slurry inlet.

Preferably the outlet is mounted in a seafloor stockpiling hood. The seafloor stockpiling hood preferably has an open bottom and preferably captures and contains the slurry on a seafloor surface of the seafloor site. The seafloor stockpiling hood preferably allows egress of water from the slurry in the hood.

The flexible slurry transfer pipe permits the slurry outlet to be moved relative to the slurry inlet, for example to accommodate varied seafloor topography, environmental conditions and/or seafloor device operating conditions. Embodiments of the first and second aspects of the invention may thus be applied in a broad range of seafloor mining applications in which it is desired to transfer a slurry from one seafloor site to another.

In embodiments of the first and second aspects of the invention the slurry inlet may be mounted upon a seafloor gathering tool configured to gather slurry from more than one seafloor location for delivery to the slurry outlet.

In embodiments of the first and second aspects of the invention, the desired location to which the slurry outlet delivers the slurry may comprise a naturally occurring seafloor site at which the slurry is released. In such embodiments the slurry outlet may simply be anchored at or proximal to the desired location to deliver slurry. The desired location may comprise a naturally occurring seafloor depression in order to promote settling of solids in the slurry into the depression.

The desired location could be artificially formed and could for example be a walled area with the walls comprising solid material placed in order to form walls. The walled area could have an open wall and for example may have a wall only to a downstream side of the desired location when a prevailing current is known to occur, such that solids settling out of the slurry delivered to the desired location will tend to gather against the open wall and thus tend to remain at the desired location. Alternatively, the walled area could be substantially surrounded by the wall and function as a settling tank for slurry delivered into the desired location. In further embodiments the desired location may comprise a substantially enclosed volume into which the slurry is pumped so as to capture solids in the slurry.

The slurry may contain waste material which is desired to be relocated on the seafloor. Alternatively, the slurry may comprise valuable solids which are desired to be recovered from the seafloor to a surface vessel, via a seafloor stockpiling site at the desired location.

According to a third aspect, the present invention provides a system for seafloor mining, the system comprising:

at least one seafloor tool that captures seafloor material in a slurry form;

a seafloor stockpiling hood for receiving seafloor material in slurry form that captures and contains seafloor material present in the slurry at a seafloor site while permitting egress of water present in the slurry from the hood;

at least one flexible stockpiling transfer pipe for transport of slurry from the seafloor tool to the seafloor stockpiling hood;

a gathering tool for extracting seafloor material captured by the hood and delivering the gathered seafloor material to a riser and lifting system that lifts the seafloor material to the surface; and a surface vessel for receiving the seafloor material from the riser and lifting system.

According to a fourth aspect, the present invention provides a method for seafloor mining, the method comprising:

at least one seafloor tool capturing seafloor material in a slurry form;

a seafloor stockpiling hood receiving the seafloor material in slurry form from the seafloor tool and capturing and containing seafloor material present in the slurry at a seafloor site while permitting egress of water present in the slurry from the hood;

extracting seafloor material from the hood and delivering the gathered seafloor material to a riser and lifting system; and a surface vessel receiving the seafloor material from the riser and lifting system.

Preferably the seafloor material is extracted in slurry form. Preferably the seafloor material extracted in slurry form is delivered to the riser and lifting system via a riser transfer pipe.

The third and fourth aspects of the present invention recognise that slurry flow rates desired for capturing seafloor material can be significantly different to the slurry flow rates desired for lifting a slurry in a riser and lift system, and thus provides for decoupling of these flow rates by use of a seafloor stockpiling hood. The respective flow rates may thus be separately optimised.

Moreover, significant operational benefits result from removing the dependence of the gathering system from the operation of the seafloor tool, such that the gathering of stockpiled material for delivery to the riser and lift system may occur even when the seafloor tool is not capturing seafloor material. This is particularly important for seafloor tools with highly variable production capacity, such as a peak capacity of around 10,000 tonnes per day but an average production of 3,000 tonnes per day, as the present invention permits a gathering system and riser and lift system to be designed to meet the average production value rather than the peak production value.

Moreover, in the case of small seafloor sites, the use of stockpiling can afford particular operational benefits in permitting a single tool to work a bench for extended lengths of time, reducing the need for multiple seafloor tools to co-habit a small bench or the need for large number of tool movements to permit alternating tools to work the small site. With use of seafloor stockpiling and suitable stockpiling transfer pipes each seafloor tool can work with considerably reduced interdependence at varying sites in the proximity of the stockpile. For example, in some embodiments the, or each, stockpile pipe may be configured to permit the associated seafloor tool to work up to 200 m away from the stockpile and up to 50 m above or below the stockpile in elevation.

The hood preferably has an open bottom and is configured such that, when positioned on a relatively flat portion of the seafloor, the hood and seafloor define a stockpiling cavity. The walls of the hood preferably completely enclose a stockpiling volume in a manner to minimise the loss of slow-settling fine particles (referred to herein as "fines"). In such embodiments, to accommodate large volumes of slurry inflow, the hood preferably permits the egress of water from the stockpiling volume so as to filter and capture the seafloor material from the slurry. To this, end, preferably a significant surface area of the walls of the hood are formed of filter material which contains fines while permitting egress of water from the hood.

A grade of the filter material, being a dimension below which solid particles can pass through the filter material, is preferably selected in order to maximise fines containment while permitting the necessary water flow rate out of the hood to accommodate slurry inflows into the hood. For example the filter material may comprise a silt curtain of 50 micron grade. The seafloor hood preferably comprises a space frame supporting the filter material, with the walls of the hood being formed by the filter material.

Capture of fines from a slurry inflow into the hood can be advantageous both environmentally in avoiding escape of plumes of the seafloor material, and operationally as such fines may represent 30% or more of the seafloor material desired to be gathered.

The, or each, seafloor tool delivering captured seafloor material to the stockpiling hood may comprise an auxiliary cutter, a bulk cutter, or a collection machine.

The gathering tool for delivering seafloor material from the seafloor hood to the riser and lift system may extract seafloor material directly from the hood. The gathering tool may be a portion of the seafloor hood, for example a suction inlet positioned within the hood and connected to a suitable transfer pipe and slurry pumping system. Additionally or alternatively, the gathering tool for delivering seafloor material from the seafloor hood to the riser and lift system may be a collection machine separate to the hood, the collection machine having a collection head configured to be brought within the hood via a collection port in the hood, the collection head comprising a suction inlet. Alternatively there may be no gathering tool of the hood, and the hood may simply be removed to leave the seafloor ore pile freely accessible to a gathering machine.

The slurry flow rate in the stockpiling transfer pipe may for example be about 3,000 $m^3$/hour, with an ore concentration of about 3%. In contrast, in such an embodiment the flow rate in the riser transfer pipe may be around 1000 $m^3$/hour at an average ore concentration of about 12%.

The stockpile hood may have angled walls forming a substantially frustoconical or frustopyramidal shape, the walls being at an angle to approximate the expected rill angle of an ore heap so as to avoid a stockpiled ore heap exerting significant outward pressure on the walls.

In alternative embodiments the seafloor stockpiling hood may comprise a settling tank with an encircling wall, whereby delivery of a slurry into the settling tank permits gathered material to settle to the base of the settling tank and permits water of the slurry to rise out of the tank, the tank having a sufficient cross section that a flow rate of water out of the tank is slow, to permit fines to settle. Preferably, the cross sectional area of the tank is sufficient, relative to an inlet slurry flow rate, that the flow rate out of the tank is about 12 m/hour or less, so that fines settling in water at a rate greater than 12 m/hour are captured.

Further, the present invention provides a system adaptable in some embodiments to deployment at significant water depths. For example some embodiments may be operable at depths greater than about 400 m, more preferably greater than 1000 m and more preferably greater than 1500 m depth. Nevertheless it is to be appreciated that the multi-tool system of the present invention may also present a useful seafloor mining option in water as shallow as 100 m or other relatively shallow submerged applications. Accordingly is to be appreciated that references to the seafloor or seabed are not intended to exclude application of the present invention to mining or excavation of lake floors, estuary floors, fjord floors, sound floors, bay floors, harbour floors or the like, whether in salt, brackish, or fresh water, and such applications are included within the scope of the present specification.

The, or each, seafloor tool may be an untethered remotely operated vehicle (ROV), or may be a tethered vehicle operated by umbilicals connecting to the surface.

The seafloor gathering tool preferably comprises a mobile slurry inlet which can be controllably positioned proximal to stockpiled material to be gathered. Thereby, suction at the slurry inlet causes water and proximal solids to be drawn into the inlet in the form of a slurry. The seafloor gathering tool preferably has a remote attachment and disconnection system for connection of a riser transfer pipe for transfer of the slurry from the stockpile to the riser base. In such embodiments, the remote connection system enables deployment and recovery of the gathering machine to and from the seafloor without recovery of the slurry riser system. The suction at the slurry inlet may be generated by a pump of the gathering tool, or alternatively may be generated by a subsea transfer pump at the riser base.

The riser and lift system preferably comprises a subsea slurry lift pump to pump slurry to the surface through a riser pipe. In preferred embodiments the seafloor stockpiling hood receives seafloor material in slurry form from the seafloor tool via a flexible stockpile transfer pipe. The stockpile transfer pipe preferably has remote connection/disconnection ability at both the seafloor tool and the hood.

The surface vessel may be a navigable vessel, a platform, a barge, or other surface hardware. The surface vessel preferably comprises dewatering equipment to dewater the slurry received from the riser, and may further comprise ore transfer and/or processing facilities such as an ore concentrator.

BRIEF DESCRIPTION OF THE DRAWINGS

An example of the invention will now be described with reference to the accompanying drawings, in which.

DESCRIPTION OF THE PREFERRED EMBODIMENTS

The following abbreviations and acronyms are used throughout the following detailed description:

| | |
|---|---|
| m | Metres |
| PSV | Production Support Vessel |
| RALS | Riser and Lifting System |
| ROV(s) | Remotely Operated Vehicle(s) |
| RTP | Riser Transfer Pipe |
| SMS | Seafloor Massive Sulphide |
| SMT(s) | Seafloor Mining Tool(s) |
| SSLP | Subsea Slurry Lift Pump |
| CM | seafloor Collecting and cutting Machine |
| AM | seafloor Auxiliary Mining machine |
| BC | seafloor Bulk Cutting machine |

Figure 1:
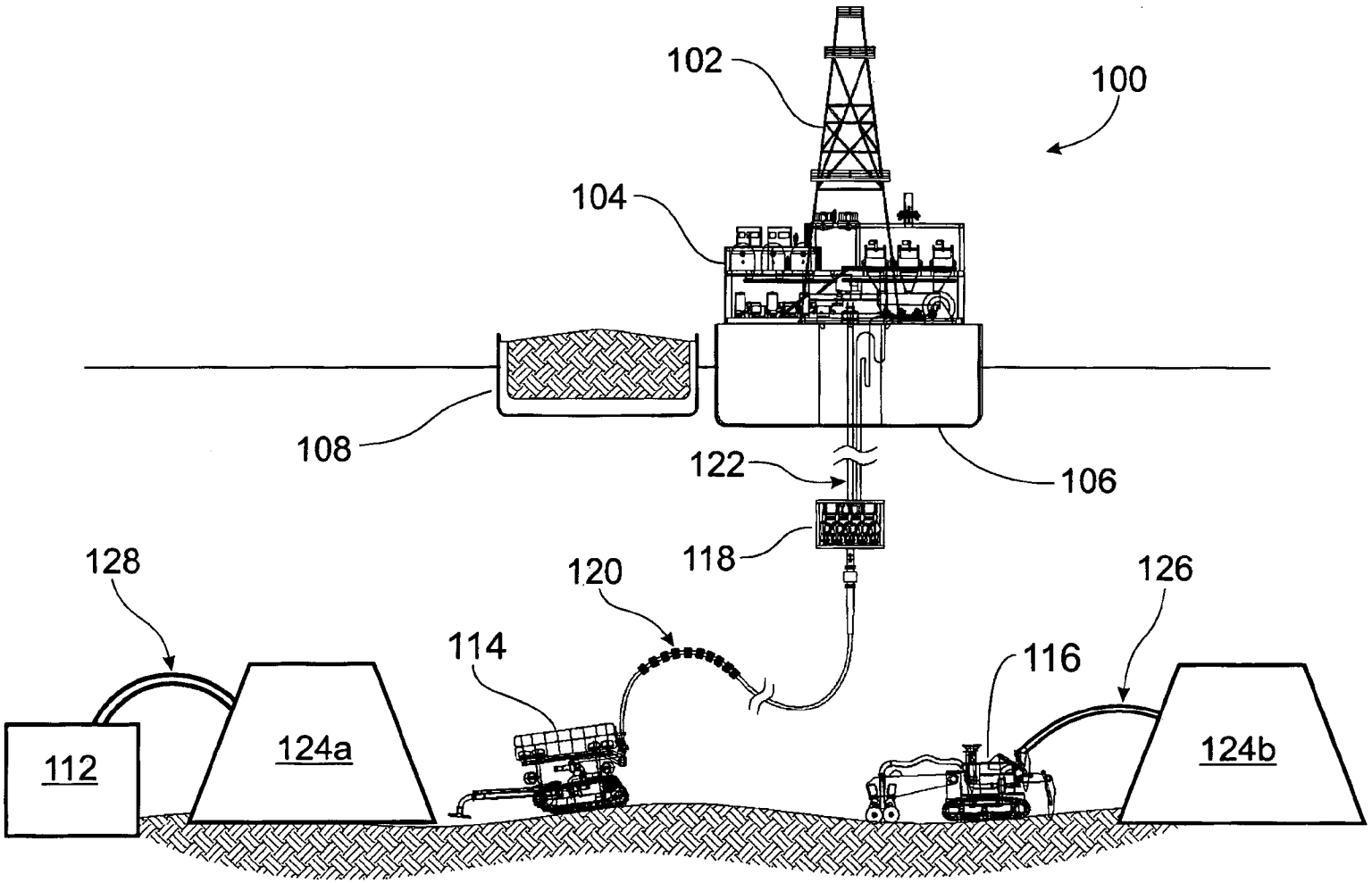
FIG. 1 is a simplified overview of a subsea system in accordance with one embodiment of the present invention.

FIG. 1 is a simplified overview of a subsea system 100 in accordance with one embodiment of the present invention. A derrick 102 and dewatering plant 104 are mounted upon an oceangoing production support vessel 106. Production support vessel (PSV) 106 has ore transfer facilities to load retrieved ore onto barge 108. The present embodiment provides a system 100 operable to 2500 m depth, however alternative embodiments may be designed for operation to 3000 m depth or greater. During production operations, one or more seafloor mining tools (SMTs) are used to excavate ore from the seabed 110. The SMTs comprise a seafloor bulk cutting (BC) machine 112, a seafloor collection machine (CM) 114 and a seafloor auxiliary mining (AM) machine 116.

Ore mined by the BC 112 is gathered upon being cut and pumped, in the form of slurry, from the BC through a stockpile transfer pipe (STP) 128 to a seafloor stockpiling device 124*a*, which captures ore from the slurry while releasing water from the slurry. CM 114 inserts a boom-mounted suction inlet into stockpile 124*a* to gather ore in slurry form and transfers this slurry to the base of the riser 122. A subsea lift pump 118 then lifts the slurry via a rigid riser 122 (shown interrupted in FIG. 1, and may be up to 2500 m long in this embodiment). The slurry travels to the surface support vessel 106 where it is dewatered by plant 104. The waste water is returned under pressure back to the seafloor to provide charge pressure for the subsea lift pump 118. The dewatered ore is offloaded onto transport barge 108 to be transported to a stockpile facility before being transported to a processing site. AM 116 works another area of the mine site and delivers it's cuttings to the stockpile device 124*a* or to another stockpile device 124*b* for later gathering by CM 114.

An inlet grizzly sizing screen is used on the CM 114 inlet to prevent over-size particles being introduced into the slurry system 120, 118, 122, 104. The system 100 is designed so that this grizzly screen size is interchangeable.

The CM 114, the BC 112 and the AM 116 each have a pump and control system which maintains the integrity of slurry flow and accounts for anticipated variability in inlet slurry conditions. The pump/gathering system incorporates automatic slurry inlet dilution and bypass valves to prevent loss of flow integrity associated with blockages and/or instantaneous changes in slurry intake density outside of the system's specified operating limits. Alternative slurry density control systems may be employed in other embodiments.

In order to minimise risk of blocking the riser transfer pipe (RTP) 120 and/or CM 114, in this embodiment the CM 114 has a dump valve that is activated when the slurry flow integrity is compromised. In alternative embodiments of the invention a dump valve may be omitted. The CM 114 of this embodiment further incorporates a back flow system to assist in clearing any slurry system blockages within the CM 114. This system is a configuration of pipes and valves that direct high pressure water from the slurry discharge line back to the suction head of the gathering machine 114. Dump valves and backflow systems are similarly provided for the stockpile hoses 126, 128 and stockpile system 124 in this embodiment.

The Riser and Lift System (RALS) 118, 122 lifts the seawater-based slurry containing the mineral ore particles to the Production Support Vessel (PSV) 106 at the surface via a vertical steel riser 122 suspended from the vessel. The ore particles mined by the SMT are collected using suction, and the particles thus become entrained in seawater-based slurry which is then pumped to the base of the riser via a Riser Transfer Pipe (RTP) 120 in a "lazy-S configuration". A Subsea Slurry Lift Pump (SSLP) 118 suspended below the base of the riser 122 will drive the slurry from the base of the riser 122 to the vessel 106, which will be over a height of up to 2500 m in this embodiment. Once at the surface, the slurry passes through a dewatering process 104. The solids are transferred to a transport barge 108 for shipment to shore. The waste water, topped up with additional seawater as required, is passed through a header tank system onboard the PSV 106 and pumped back down to the base of the riser 122 via auxiliary seawater pipelines clamped to the main riser pipe 122. The return seawater, on arrival at the base of the riser 122, is then used to drive the positive-displacement chambers of the SSLP 118 prior to being discharged into the sea close to the depth at which it was originally collected. Alternative means to drive the SSLP 118 can also be provided, for example electric, hydraulic, pneumatic or electro-hydraulic systems, among others.

The riser 122 is supplied in sections (joints), each joint being made up of a central pipe for the transportation of slurry mix from the base of the riser to the surface, together with two water return lines for powering the Subsea Slurry Lift Pump 118 from the surface. Plus, a Dump Valve System to enable all slurry in the Riser pipe 122 to be flushed from the system in the event of unexpected shut down, to prevent blockages.

The Subsea Slurry Lift Pump (SSLP) 118 is suspended at the bottom of the riser 122 and receives slurry from the CM 114 via the riser transfer pipe 120. The SSLP 118 subsequently pumps the slurry to the Production Support Vessel 106. The pump assembly 118 comprises two pump modules, each module containing a suitable number of positive displacement pump chambers driven by pressurised water delivered from surface pumps via seawater lines attached to the riser 122. The pump 118 is controlled from the surface vessel 106 by a computerised electronic system which passes control signals through umbilical cables to a receiving control unit on the pump 118. Functions are operated hydraulically with a bank of dual redundancy electro-hydraulic power packs located on the pump 118. The electrical power to drive the power packs is fed through the same umbilical cables which carry the control data signals from the surface to the pump 118. The two (dual redundancy) umbilicals for control of the SSLP 118 are secured to clamps on the riser 122 with the weight of the umbilical distributed along the riser joints.

The main function of the surface pumps is to provide pressurized water to drive the Subsea Slurry Lift Pump 118. Multiple triplex or centrifugal pumps will be installed on the Production Support Vessel 106, all taking water removed from the slurry mix (<0.1 mm residues) in the dewatering process, made up with surface seawater to the required volume before being pumped down the water return lines to the SSLP 118 at depth. The surface system incorporates a return water header tank fed from the dewatering system and topped up with the required volume to drive the SSLP 118 using centrifugal pumps extracting filtered surface seawater via a sea chest in the vessel hull. The water in the header tank is delivered to a bank of charge pumps which boost the pressure for delivery to the inlet of the surface pumps.

A derrick and draw-works system 102 is installed on the support vessel 106 in order to deploy and recover the riser 122 and subsea lift pump 118. In addition handling systems within the area of the derrick 102 move the SSLP 118 into a designated maintenance area.

A surge tank is incorporated between the RALS discharge and the dewatering plant 104 to moderate instantaneous slurry variability prior to feed into the dewatering plant. The dewatering system 104 will receive ore from the RALS 122 as mineral slurry. To ensure that the ore is suitable for transport, the large volume of water within the slurry must be removed. The dewatering process of this embodiment uses three stages of solid/liquid separation:

Stage 1—Screening—using vibrating twin double deck screens

Stage 2—De-sanding—using hydro cyclones and centrifuges

Stage 3—Filtration—using disk filters

Vibrating screen decks are used to separate the coarse particles from the slurry stream. These coarse particles are considered to be free draining and will not require any mechanical dewatering to achieve the required moisture limit. A vibrating basket centrifuge is used to provide mechanical dewatering of the medium particle size fraction to ensure the required moisture limit is reached.

Hydro cyclones are then used to separate the valuable fine particles (>0.006 mm) from the slurry feed which have not been removed by the screen decks. Disk filters are used to dewater the valuable fines (between 0.5 mm and 0.006 mm) prior to loading on to the transport barge 108. This ore size fraction requires greater mechanical input (vacuum) to remove moisture. The ore/slurry waste water is then returned to the seafloor via a pump-set and piping system. A dewatering plant 104 is installed on the topsides surface facilities, in this case the PSV 106, to reduce the moisture content of the ore to below the transportable moisture limit (TML) of the ore. Reducing the moisture content below the TML allows safe carriage of the ore by ship. It also reduces the cost of transport due to the reduced volume of material being shipped. Alternative embodiments may utilise any suitable other configuration of dewatering plant.

In the case of dewatering plant 104 failure, the gathering machine 114 will disengage the seafloor 110 and continue pumping seawater. The volume of the surge tank is sufficient to accommodate the volume of slurry in the RALS 122, 118 in the case of any dewatering plant 104 failure. The slurry in the RALS 118, 122 will be discharged to the surge tank, or vibrating screens and surge tank, until seawater only is discharged to surface, at which time the dewatering plant 104 by-pass will be engaged and water circulated back to the subsea lift pump or the RALS/gathering machine shut down.

The PSV 106 remains on location for the duration of mining and supports all mining, processing and offshore loading activities to enable safe and efficient mining of the seafloor deposits 110, recovery of cut ore to the surface, treatment (dewatering, including return of treated water to seafloor) and off-loading of the dewatered ore into the transportation barges 108 for onward shipment to stockpiling and subsequent treatment facilities. Station holding capability for the vessel is via dynamic positioning. Alternative station holding may be by mooring the vessel, or by a combination of both dynamic positioning and mooring depending on site specific conditions.

The system 100 of the present embodiment thus provides a means and method for achieving steady state seafloor mining and gathering production, such as seafloor massive sulphide (SMS) production.

Figure 2:
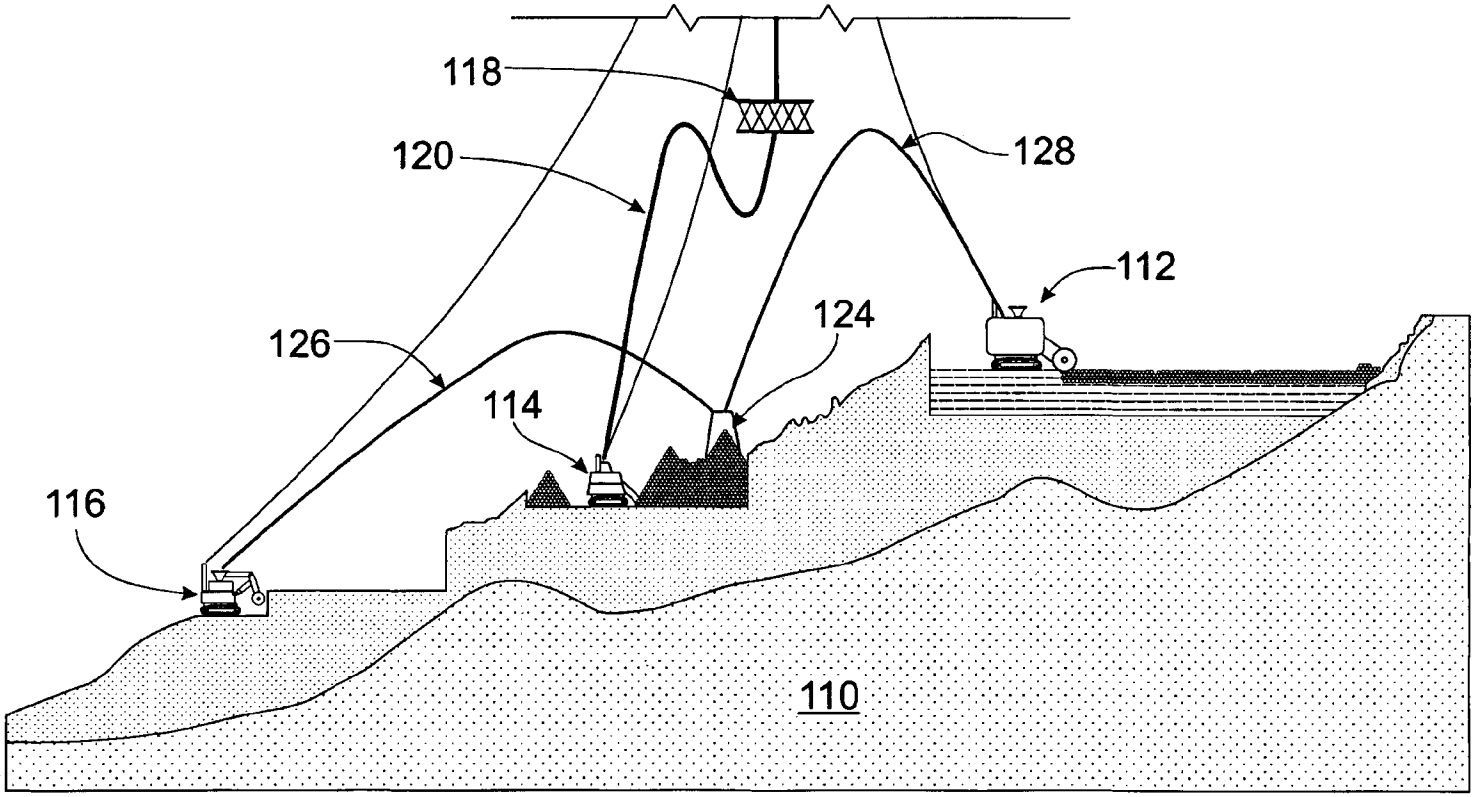
FIG. 2 illustrates another embodiment involving simultaneous operation of seafloor tools sharing a single stockpiling device.

FIG. 2 illustrates simultaneous operation of BC 112, AM 116 and CM 114, as made possible by the use of a single shared stockpiling device 124. Cuttings from BC 112 and AM 116 are simultaneously delivered in slurry form into stockpiling hood 124. As shown, new stockpiles of ore are built up within hood 124, and on top of previously formed stockpiles. CM 114 simultaneously works to collect stockpiled cuttings and deliver them in slurry form vie RTP 120 to RALS 118, 122.

STPs 128 and 126 may be configured to take any suitable shape while in use, whether an inverted catenary as shown in FIG. 2, an "M" shape, or otherwise.

Figure 3B:
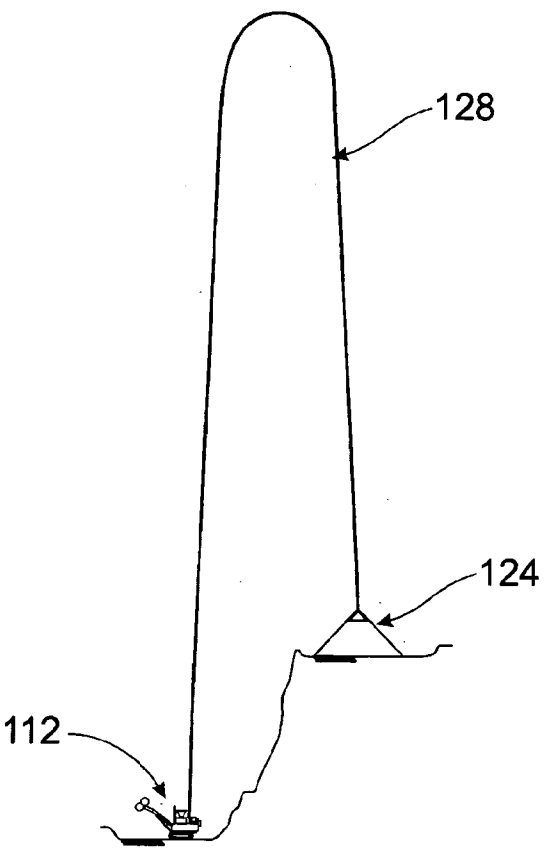
FIGS. 3*a* to 3*d* illustrate the example operational positions of the stockpiling system.
Figure 3A:
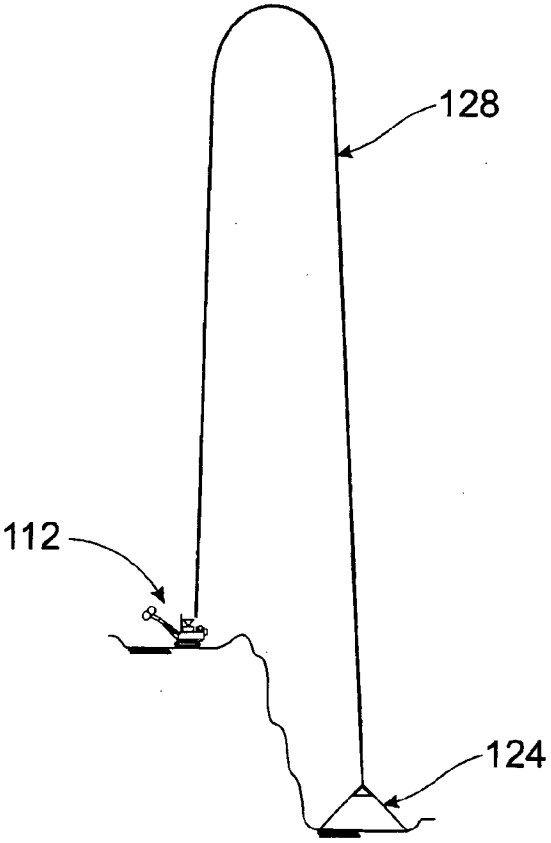
Figure 3C:
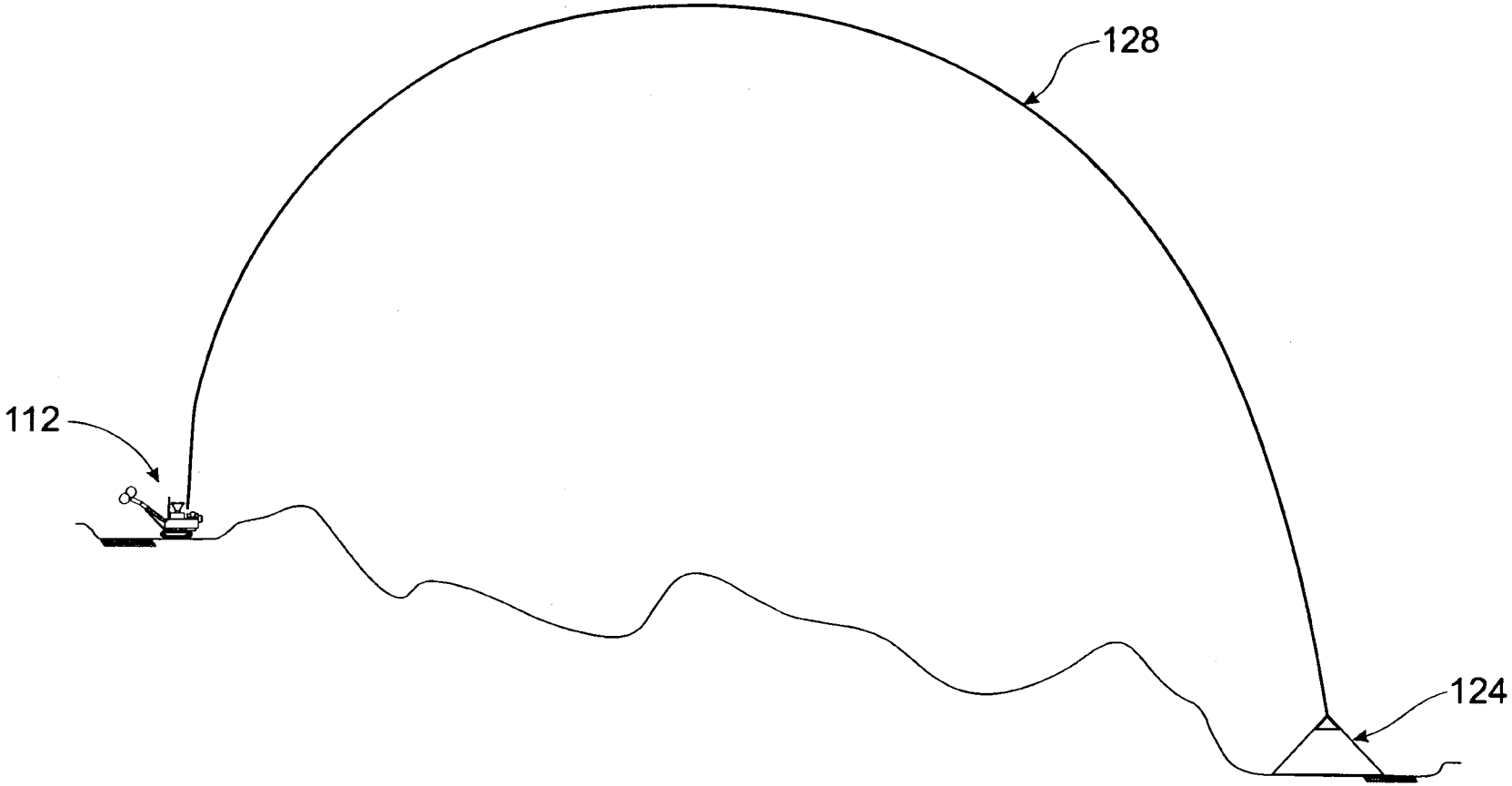
Figure 3D:
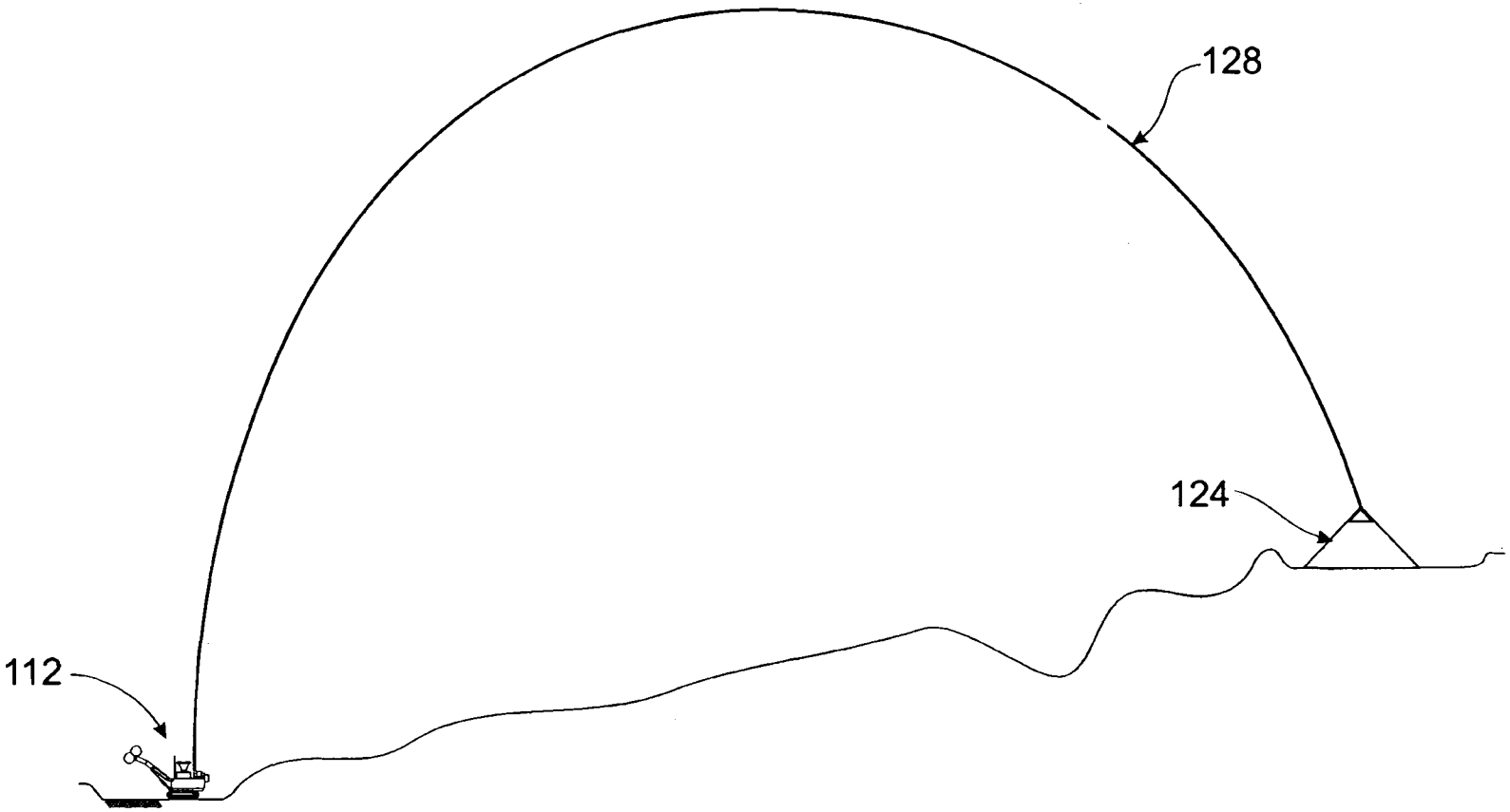

FIGS. 3*a* to 3*d* illustrate example operational positions of the system 100, primarily determined by the stockpiling hose 128 of the seafloor tool 112, which together define an operational envelope of the system. With a STP 128 having a length of approximately 320 m and a hose inner diameter of approximately 425 mm, the horizontal freedom of movement of the BC 112 relative to a stockpiling site of the hood 124 is 50 to 200 m, in any direction, and the vertical freedom of movement of the BC 112 relative to the stockpile site of the hood 124 is +/−50 m. FIG. 3*a* illustrates the BC 112 in a position that is higher than, but relatively close to, the hood 124. FIG. 3*b* illustrates the BC 112 in a position that is lower than, but still relatively close to the hood 124. FIG. 3*c* illustrates the BC 112 in a position that is higher than, but relatively far away from, the hood 124. FIG. 3*d* illustrates the BC 112 in a position that is lower than, but still relatively far away from, the hood 124.

In one seafloor mining embodiment, it is desired that both the auxiliary cutter (AC) 116 and a bulk cutter (BC) 112 are able, at certain times, to simultaneously work respective sites within a mine area, each producing a slurry flow of up to 3,000 $m^3$/hour. The present invention offers a significant benefit in avoiding the need for two respective RALSs each capable of transferring 3,000 $m^3$/hour. Instead, the slurry flows from the AC 116 and the BC 112 may be delivered to one or more seafloor stockpiling hoods 124, and a single RALS 118, 122 may extract stockpiled ore in a slurry at around 1000 $m^3$/hour. In a mine site with relatively small benches, it is to be expected that the BC 112 and AC 116 will not operate continuously due to inter-site movement, so that operation of the RALS 118, 122 at a lower rate for a greater period of each day can be expected to roughly maintain site throughput, with the, or each, stockpile 124 operating as an operational buffer.

Figure 4:
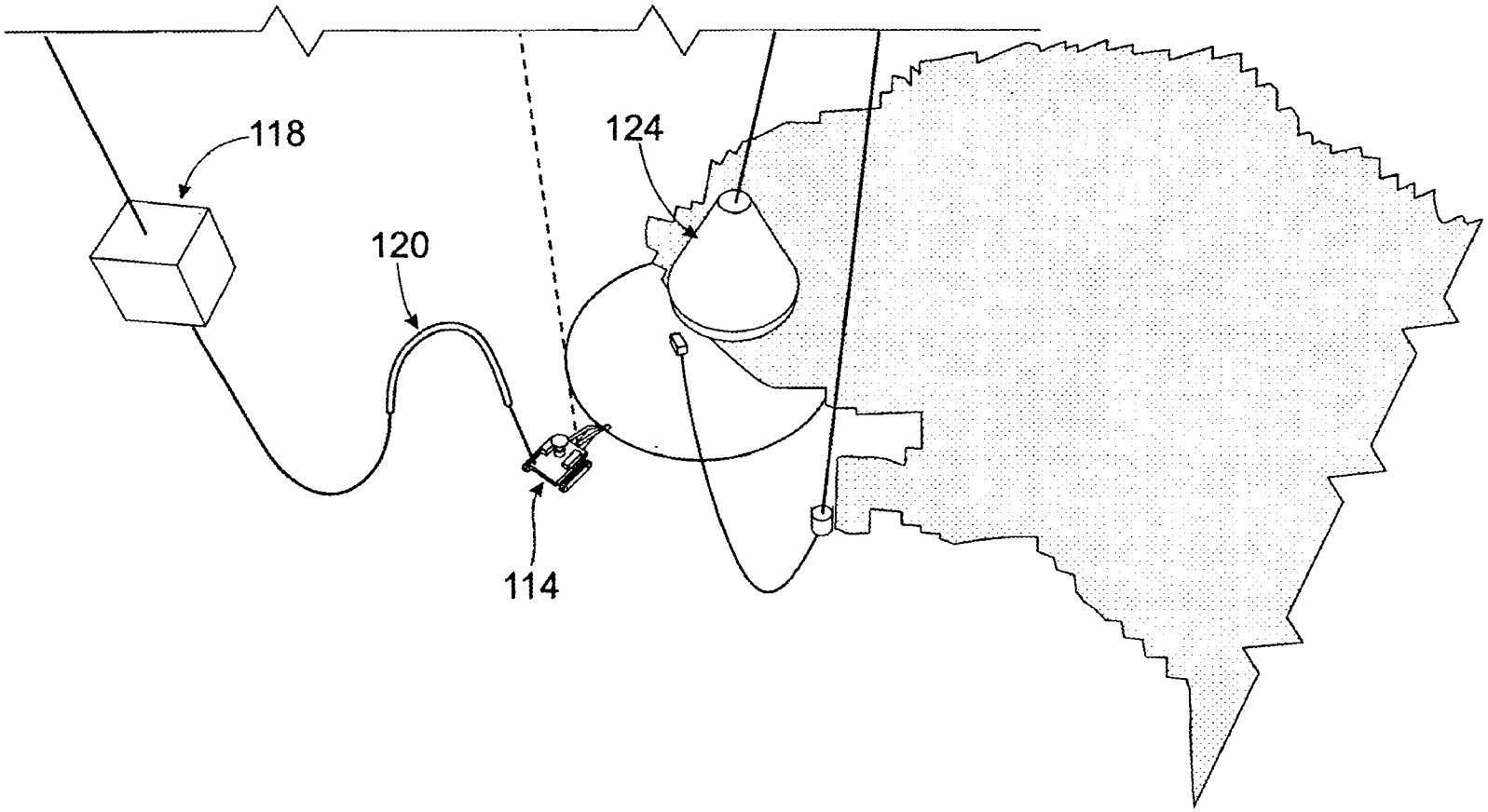
FIG. 4 illustrates the seafloor mining system of FIG. 2 from an elevated perspective.
Figure 5A:
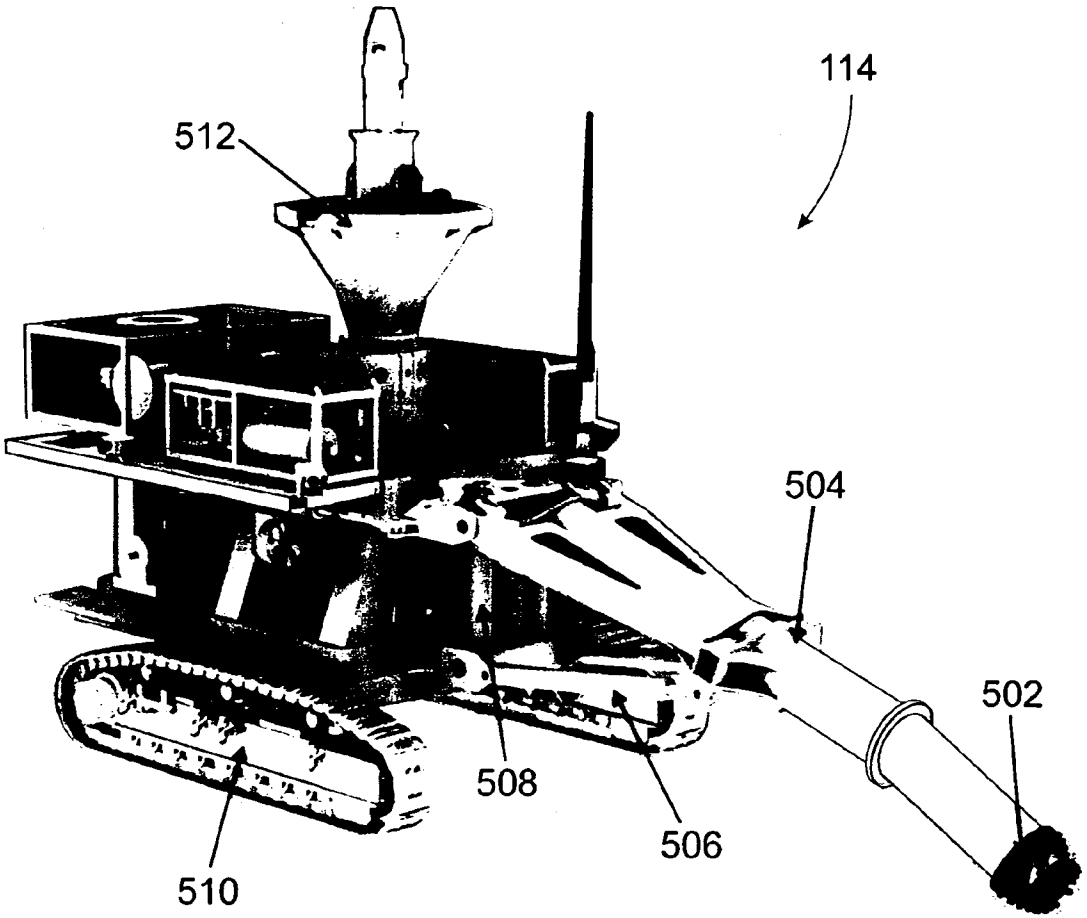
FIGS. 5*a*-5*d* illustrate the collection machine in greater detail.
Figure 5C:
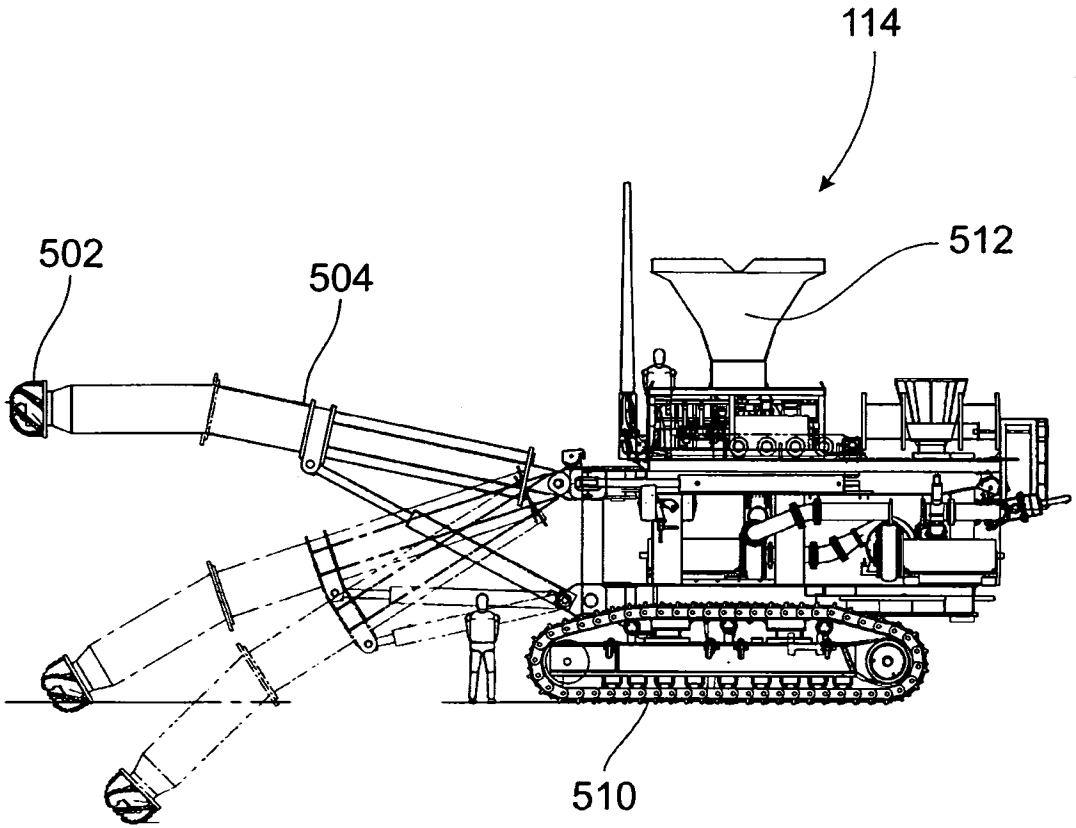
Figure 5B:
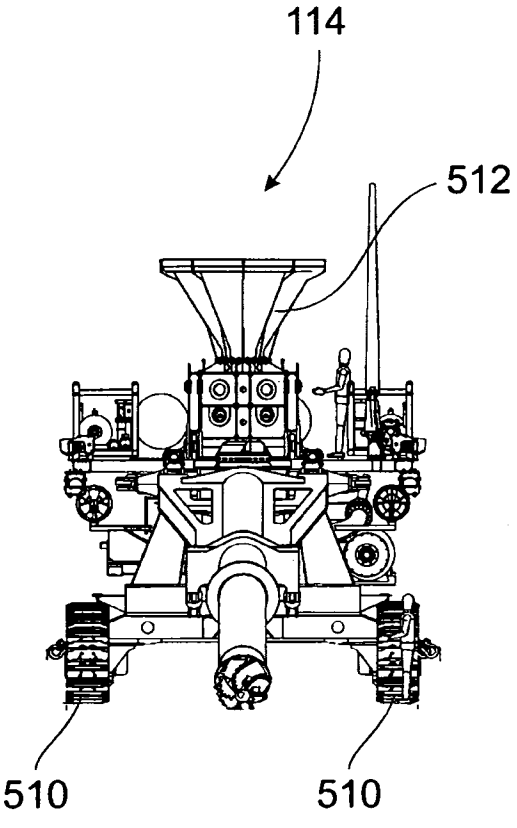
Figure 5D:
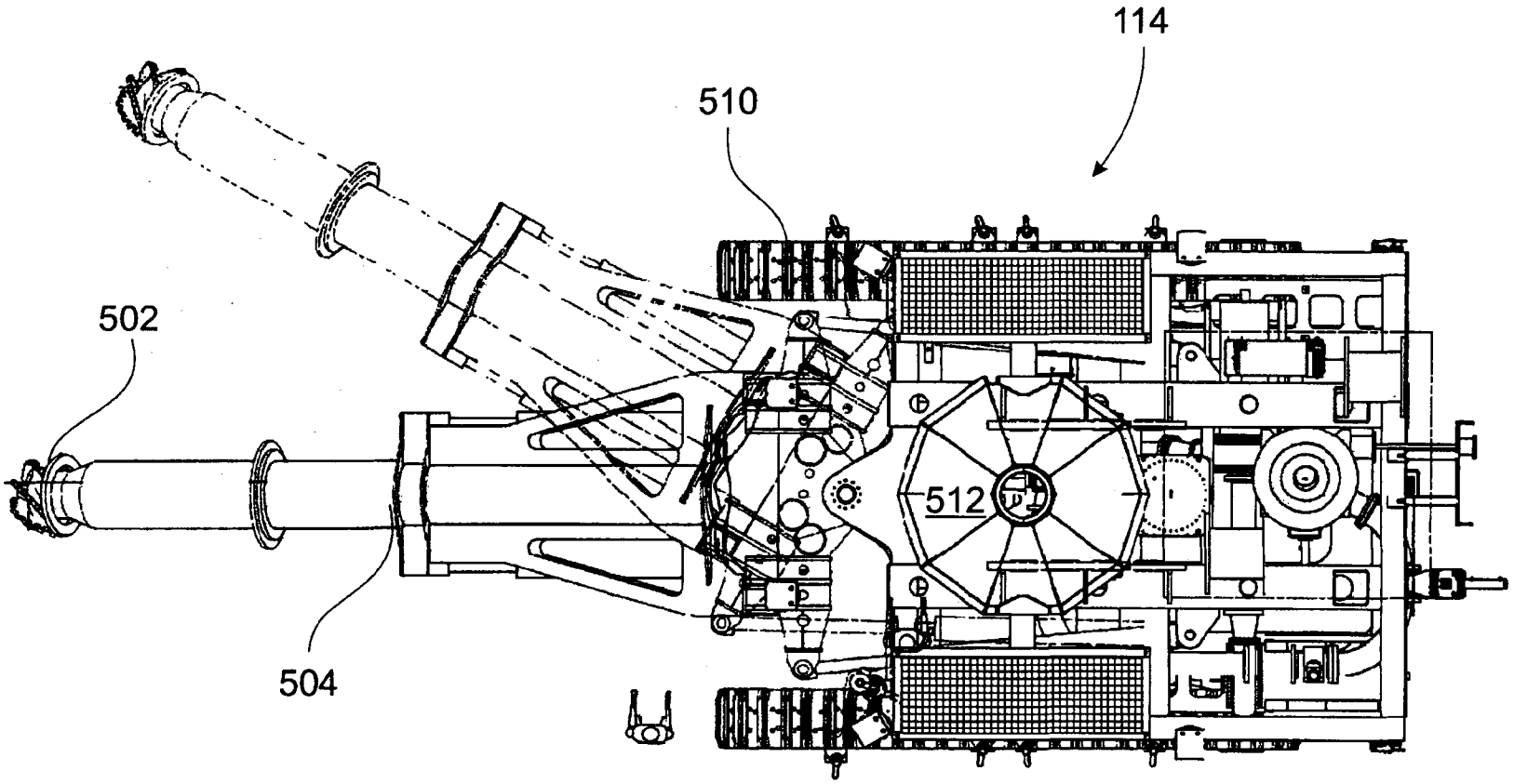

FIG. 4 illustrates an example of the seafloor mining system of the present embodiment from an elevated perspective.

FIGS. 5*a*-5*d* illustrate an example collection machine (CM) 114 in greater detail. The CM 114 has a crown cutter collector 502, a boom/ladder 504, a chassis 506, a slew yoke 508, crawler assembly 510 and lift point 512. In this configuration the crown cutter has a suction head grid at 50 mm working as a rock guard, a collection range height of −2 m to 5 m, and a collection range width of +/−4 m (8 m total width). Such a CM 114 can be utilised in the present invention to extract seafloor material in slurry form from and/or adjacent to the stockpile device 124.

Figure 6:
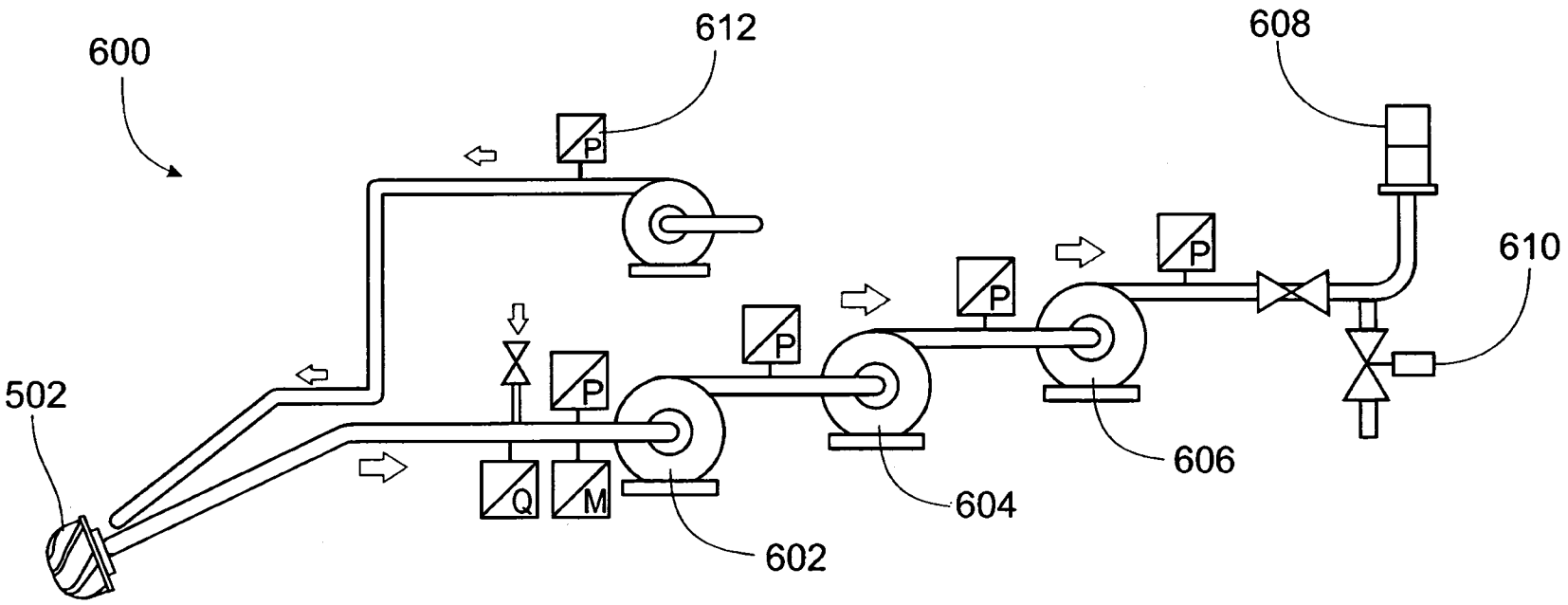
FIG. 6 illustrates the collection machine dredge pumping system.

FIG. 6 illustrates an example dredge pumping system 600 of the CM 114. The dredge pumping system 600 has three pumps 602, 604, and 606 that generate a combined outlet pressure of approximately 1750 kPa above ambient pressure. The pumping system 600 has an outlet 608 which is fluidly connected to the riser transfer pipe (RTP). A dump valve 610 is provided adjacent the outlet 608 that is activated when the slurry flow integrity is compromised. A back flush system 610 is also provided which can be used to back flush the crown cutter collector 502, particularly when the crown cutter collector 502 is clogged or has a blockage. The back flush system 610 can also be used as a dilution system to dilute the seafloor material being extracted if desired.

Figure 7:
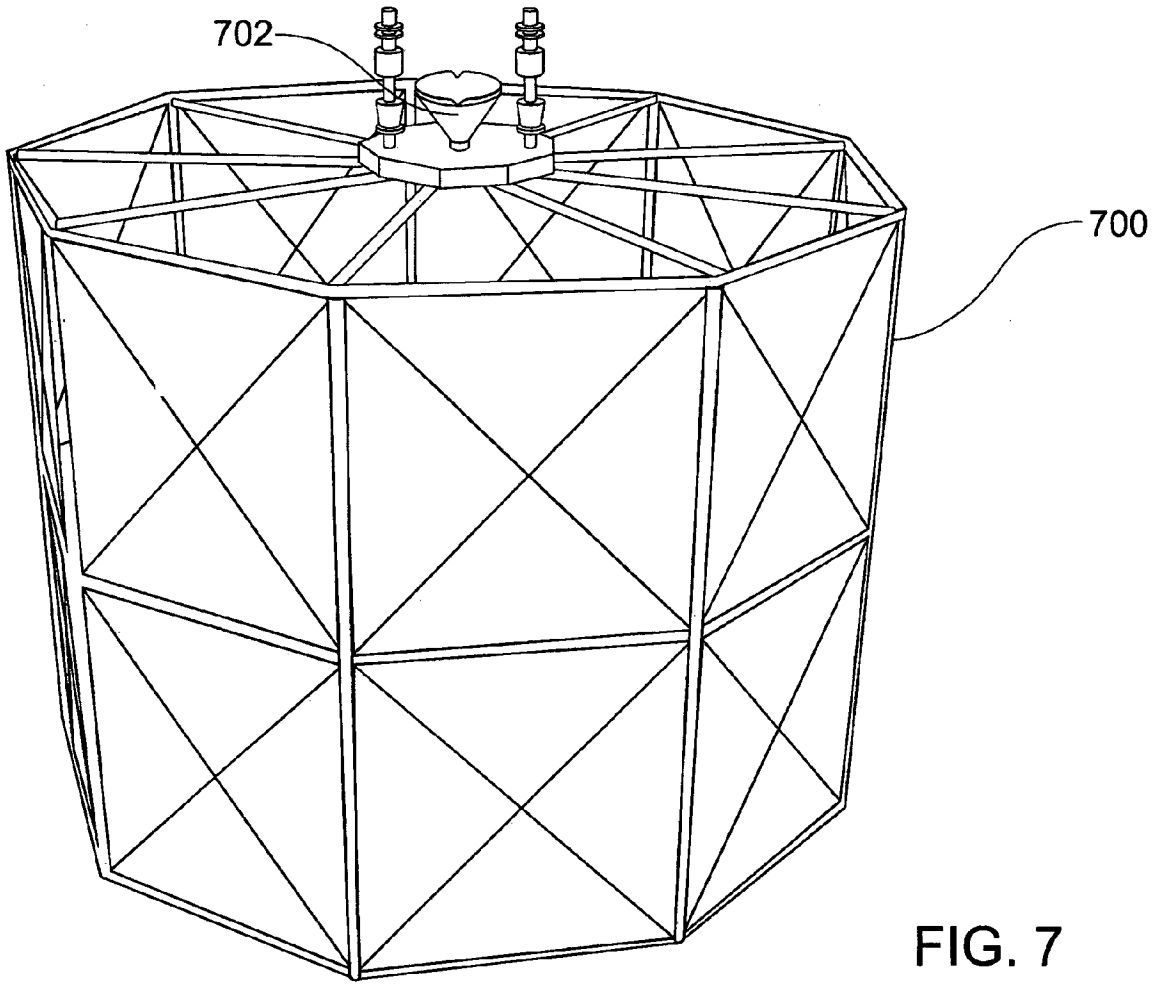
FIG. 7 illustrates another embodiment in which the stockpiling device is a settling tank.
Figure 8:
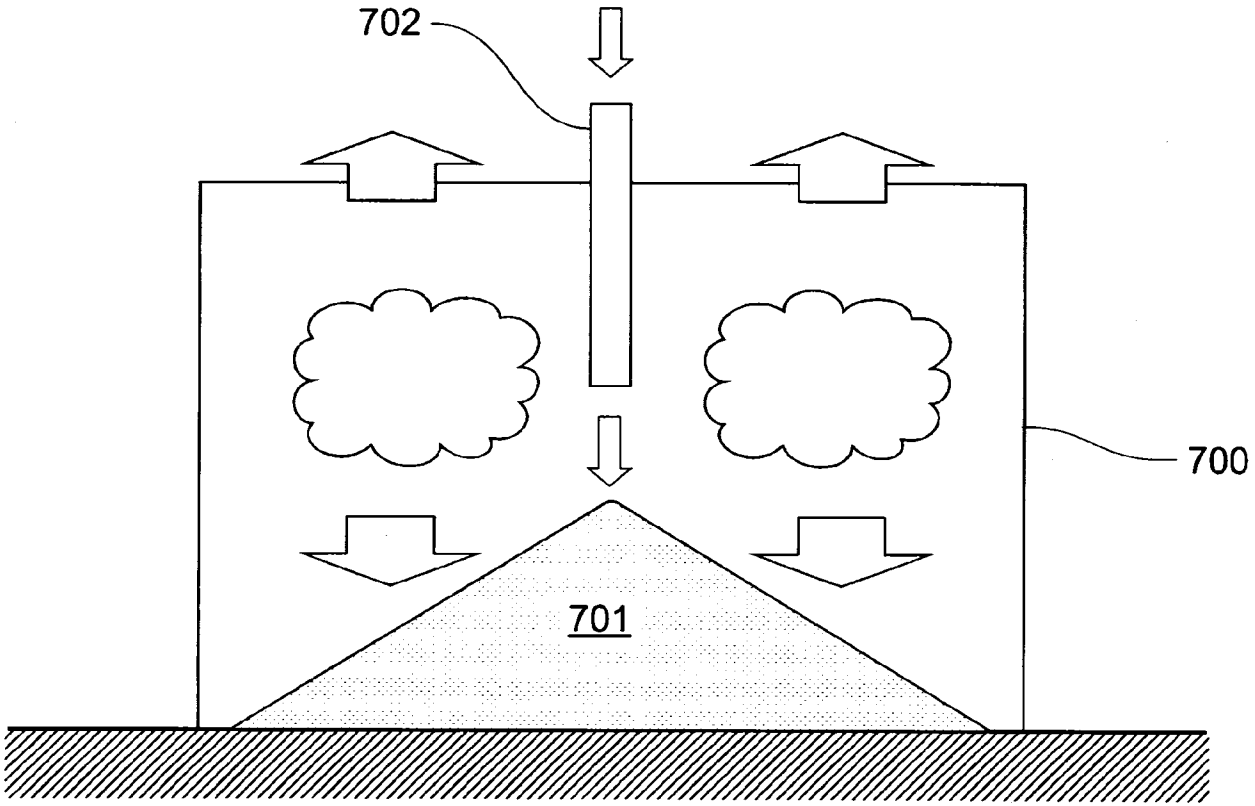
FIG. 8 illustrates fluid flows and settling rates in the embodiment of FIG. 7.

FIGS. 7 and 8 illustrate an alternative embodiment of the invention in which the stockpiling device 124 is, or at least includes, a settling tank 700 with open top. Slurry from the BC 112 and/or the AM 116 is delivered into the top of the tank 700 by a delivery inlet 702. The slurry is typically delivered at up to 6000 $m^3$/hour, at which rate the flow rate upwards out of the tank is 12 m/hour. In this configuration, particles less than approximately 69 micrometers in size will settle too slowly and will exit the tank, but all fines larger than approximately 69 micrometers will have suitable conditions for settling in a heap 704 and will thus be captured and contained in the settling tank 700.

The stockpiling system of the present invention could be used as part of alternative offshore system designs. For example, while the described embodiment addresses seafloor material of value which is to be recovered to a surface vessel, in accordance with the first and second aspects of the invention the slurry may simply be delivered to a desired location at a site distal from the slurry inlet, for example to relocate waste to another seafloor site distal from a site of interest. The present invention also recognises that a range of costs and losses arise from the double handling of seafloor material involved in such a stockpiling method, but recognises that such costs and losses can by use of the present systems and techniques be minimised while affording a significant net operational benefit to some seafloor mining applications.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A system for seafloor stockpiling, the system comprising:

a flexible transfer pipe for carrying slurry from a slurry inlet to a slurry outlet that is positioned at a desired location distal from the slurry inlet; and a seafloor stockpiling hood located on the seafloor at a seafloor site;

wherein the seafloor stockpiling hood has an open bottom, an internal cavity defined by one or more walls of the seafloor stockpiling hood and the seafloor at the seafloor site and allows egress of water through one or more walls of the seafloor stockpiling hood;

wherein the slurry inlet receives slurry from a seafloor collection machine; and wherein the slurry outlet is mounted in the seafloor stockpiling hood located on the seafloor at the seafloor site and delivers the slurry to the internal cavity of the seafloor stockpiling hood defined by the seafloor stockpiling hood and the seafloor at the seafloor site.

2. The system for seafloor stockpiling of claim 1, wherein the outlet is mounted to a settling tank located on the seafloor at the seafloor site.

3. The system for seafloor stockpiling of claim 1, further comprising a gathering tool that extracts seafloor material from the delivered slurry at the seafloor site, wherein the gathering tool delivers the extracted seafloor material to a riser and lifting system via a flexible riser transfer pipe.

4. The system for seafloor stockpiling of claim 3, wherein the riser and lifting system delivers the extracted seafloor material from the gathering tool to a surface vessel.

5. The system for seafloor stockpiling of claim 1, wherein there is more than one slurry inlet, each associated with a seafloor collection machine.

6. The system for seafloor stockpiling of claim 5, wherein each slurry inlet has an associated slurry outlet and the slurry outlets all deliver the slurry to the same seafloor site.

7. The system for seafloor stockpiling of claim 1, wherein the slurry inlet and outlet can be moved relative to each other.

8. A method for seafloor stockpiling, the method comprising:

capturing seafloor material in a slurry form;

carrying captured slurry through a flexible transfer pipe to a slurry outlet;

positioning the slurry outlet in a seafloor stockpiling hood located at a desired seafloor site distal from the slurry inlet, wherein the seafloor stockpiling hood has an open bottom, an internal cavity defined by one or more walls of the seafloor stockpiling hood and the seafloor at the seafloor site and allows egress of water through one or more walls of the seafloor stockpiling hood; and delivering the slurry to the internal cavity of the seafloor stockpiling hood.

9. The method for seafloor stockpiling of claim 8, wherein the slurry is captured and contained by the seafloor stockpiling hood.

10. The method for seafloor stockpiling of claim 8, wherein the outlet is mounted to a settling tank located on the seafloor at the desired seafloor site and the slurry is captured and contained in the settling tank.

11. The method for seafloor stockpiling of claim 8, further comprising extracting captured seafloor material from the desired seafloor site using a gathering tool.

12. The method for seafloor stockpiling of claim 11, wherein the gathering tool delivers extracted seafloor material to a riser and lifting system via a flexible riser transfer pipe.

13. The method for seafloor stockpiling of claim 8, further comprising delivering the extracted seafloor material to a surface vessel.

14. A system for seafloor mining, the system comprising:

at least one seafloor tool that captures seafloor material in a slurry form;

a seafloor stockpiling hood for receiving seafloor material in slurry form that captures and contains seafloor material present in the slurry at a seafloor site while permitting egress of water present in the slurry through one or more walls of the hood, the seafloor stockpiling hood having an open bottom and an internal cavity defined by one or more walls of the seafloor stockpiling hood and the seafloor at the seafloor site;

at least one flexible stockpiling transfer pipe for transport of slurry from the seafloor tool to the seafloor stockpiling hood;

and a surface vessel for receiving the seafloor material from the riser and lifting system.

15. A method for seafloor mining, the method comprising:

at least one seafloor tool capturing seafloor material in a slurry form;

a seafloor stockpiling hood receiving the seafloor material in slurry form from the seafloor tool and capturing and containing seafloor material present in the slurry at a seafloor site while permitting egress of water present in the slurry through one or more walls of the hood, wherein the seafloor stockpiling hood has an open bottom and an internal cavity defined by one or more walls of the seafloor stockpiling hood and the seafloor at the seafloor site;

extracting seafloor material from the hood and delivering the gathered seafloor material to a riser and lifting system; and a surface vessel receiving the seafloor material from the riser and lifting system.

* * * * *